US012298108B2

(12) United States Patent
Beck

(10) Patent No.: US 12,298,108 B2
(45) Date of Patent: May 13, 2025

(54) BALLISTIC VEST SYSTEM WITH BALLISTIC RIDGE COMPONENT

(71) Applicant: TYR Tactical, LLC, Peoria, AZ (US)

(72) Inventor: Jason Beck, Peoria, AZ (US)

(73) Assignee: TYR Tactical, LLC, Peoria, AZ (US)

( * ) Notice: Subject to any disclaimer, the term of this patent is extended or adjusted under 35 U.S.C. 154(b) by 340 days.

(21) Appl. No.: 16/820,278

(22) Filed: Mar. 16, 2020

(65) Prior Publication Data

US 2020/0271424 A1 Aug. 27, 2020

Related U.S. Application Data

(63) Continuation of application No. 14/497,508, filed on Sep. 26, 2014, now Pat. No. 10,591,256.

(60) Provisional application No. 61/883,140, filed on Sep. 26, 2013.

(51) Int. Cl.

| | |
|---|---|
| ***F41H 1/02*** | (2006.01) |
| ***A41D 1/04*** | (2006.01) |
| ***A41D 27/02*** | (2006.01) |
| ***A41D 31/04*** | (2019.01) |

(52) U.S. Cl.

CPC ..... *F41H 1/02* (2013.01); *A41D 1/04* (2013.01); *A41D 27/02* (2013.01); *A41D 31/04* (2019.02)

(58) Field of Classification Search

CPC ..... F41H 1/02; F41H 5/00; F41H 5/02; F41H 5/04; F41H 5/0492; A41D 1/04; A41D 27/02; A41D 31/04; A41D 31/0011

USPC ..... 2/2.5

See application file for complete search history.

(56) References Cited

U.S. PATENT DOCUMENTS

| | | | | |
|---|---|---|---|---|
| 3,891,996 | A * | 7/1975 | Leach | F41H 1/02 2/2.5 |
| 7,712,148 | B2 * | 5/2010 | Carlson | F41H 1/02 2/2.5 |
| 10,591,256 | B2 * | 3/2020 | Beck | A41D 31/04 |
| 2002/0069444 | A1 * | 6/2002 | Graham | F41H 1/02 2/2.5 |
| 2011/0145980 | A1 * | 6/2011 | D'Alessandro | A41D 27/20 2/254 |
| 2013/0133130 | A1 * | 5/2013 | Crye | F41H 1/02 89/922 |

* cited by examiner

*Primary Examiner* — Katherine M Moran
(74) *Attorney, Agent, or Firm* — KW Law, LLP

(57) ABSTRACT

Embodiments of a ballistic vest system having a ballistic vest plate carrier with a ballistic plate engaged to a ballistic ridge component disposed therein that provides protection against side spall and back face deformation caused by the impact of ballistic projectiles and shrapnel along the peripheral area of the ballistic plate and methods to manufacture such a ballistic vest systems are generally described herein. Other embodiments of a ballistic vest system may be described and claimed.

15 Claims, 10 Drawing Sheets

BALLISTIC VEST SYSTEM WITH BALLISTIC RIDGE COMPONENT

CROSS REFERENCE TO RELATED APPLICATIONS

The present application is a continuation of U.S. Ser. No. 14/497,508 filed on Sep. 26, 2014, entitled *BALLISTIC VEST SYSTEM WITH BALLISTIC RIDGE COMPONENT*, and issued as U.S. Pat. No. 10,591,256, which claims benefit to U.S. provisional patent application Ser. No. 61/883,140 filed on Sep. 26, 2013, all of which are hereby incorporated by reference in their entirety for any purpose.

FIELD

The present disclosure relates to ballistic vest systems having a ballistic plate, and in particular, to ballistic vest systems having a ballistic ridge component located along the peripheral area of the ceramic plate for providing protection against side spall and back face deformation caused by ballistic projectiles and shrapnel impacting along the peripheral area of the ballistic plate.

BACKGROUND

A ballistic vest is an item of personal armor that helps absorb the impact from firearm-fired projectiles and shrapnel from explosions and is worn on the torso of an individual. Ballistic vests may include soft body armor made from multiple layers of woven or laminated fibers in addition to a metal or ceramic plate that provides additional protection from rifle rounds. Although such ballistic vests are suitable to protect the individual from most ballistic projectile impacts, there are certain impacts that occur when the trajectories of the ballistic projectiles are at an angle and impact the peripheral edge of the ballistic plate, which can cause side spall or back face deformation. Back face deformation occurs when the ballistic projectile impacts the ballistic plate and causes the backside of the ballistic plate to deform or bulge outwardly. Side spall occurs when the ballistic projectile impacts the peripheral area of the ballistic plate such that shrapnel from the ballistic projectile impact and/or debris of material from the impacted portion of the ballistic plate can potentially penetrate the soft body armor and injure the individual. Referring to FIG. 1, a prior art ballistic vest 10 is shown that illustrates the side spall 16 that occurs when a ballistic projectile impacts the ballistic plate 14 along the peripheral area 18 of the ballistic plate 14. As the ballistic projectile impacts the peripheral area 18 of the ballistic plate 14, the side spall 16 and back face deformation 15 from the ballistic projectile can cause debris from the ballistic plate 14 as well as shrapnel from the ballistic projectile to penetrate or deform the backside 20 of the ballistic plate 14, which can potentially injure the individual wearing the prior art ballistic vest 10. As such, there is a need for further improvements that enhance the protection provided by a ballistic vest including protection from side spall and back face deformation to the peripheral area of the ballistic plate.

BRIEF DESCRIPTION OF THE DRAWINGS

Corresponding reference characters indicate corresponding elements among the various views of the drawings. The headings used in the figures should not be interpreted to limit the scope of the claims.

DESCRIPTION

As described herein, embodiments of a ballistic vest system having a ballistic ridge component positioned adjacent the peripheral area of a ballistic plate for protecting an individual from side spall and decreasing back face deformation caused by ballistic projectiles impacting the peripheral area of the ballistic plate.

Figure 1:
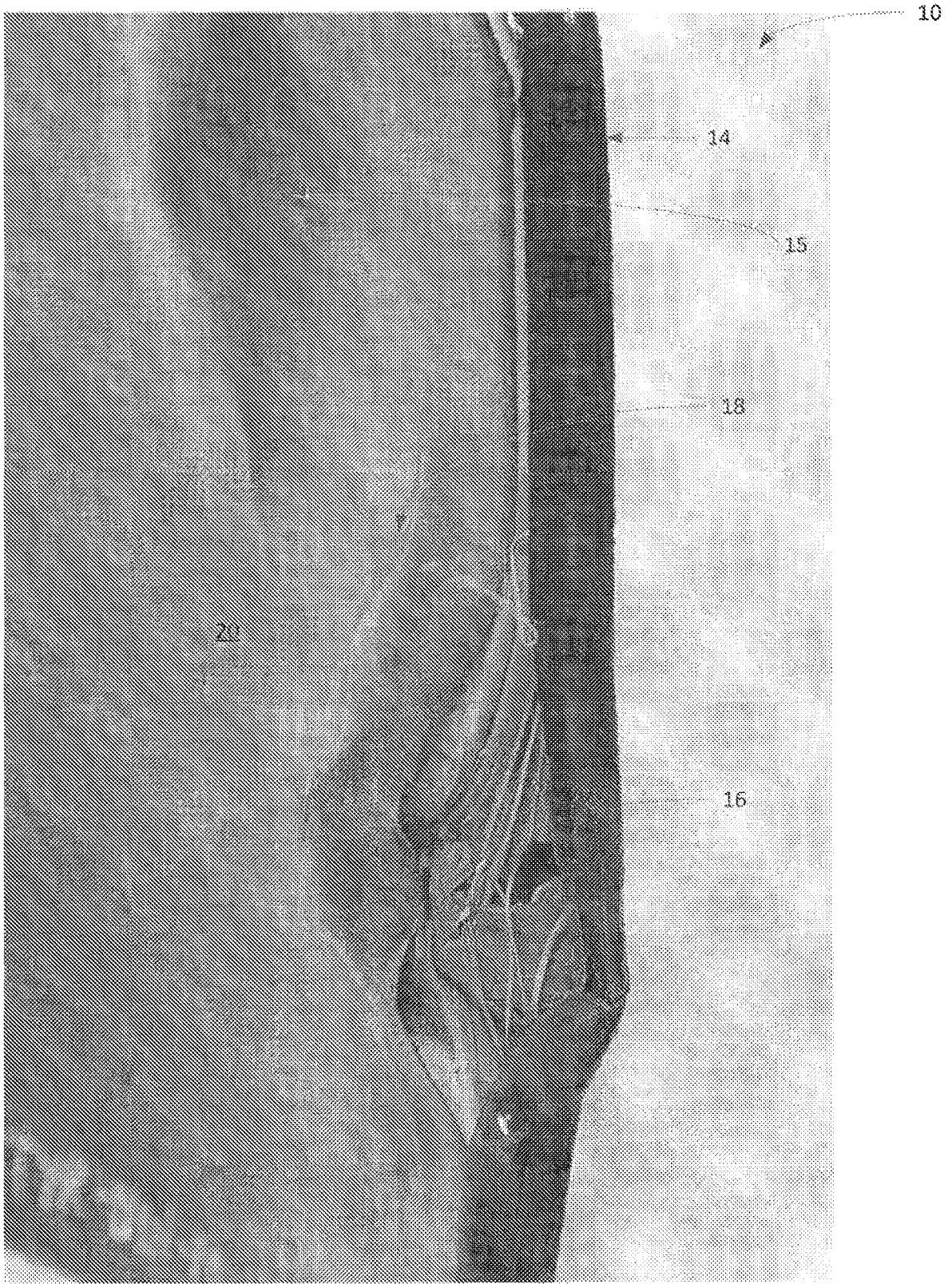
FIG. 1 (Prior Art)
FIG. 1 is a picture of a prior art ballistic vest system that illustrates the effects of side spall produced by a bullet impacting proximate the side of a ballistic plate.
Figure 2:
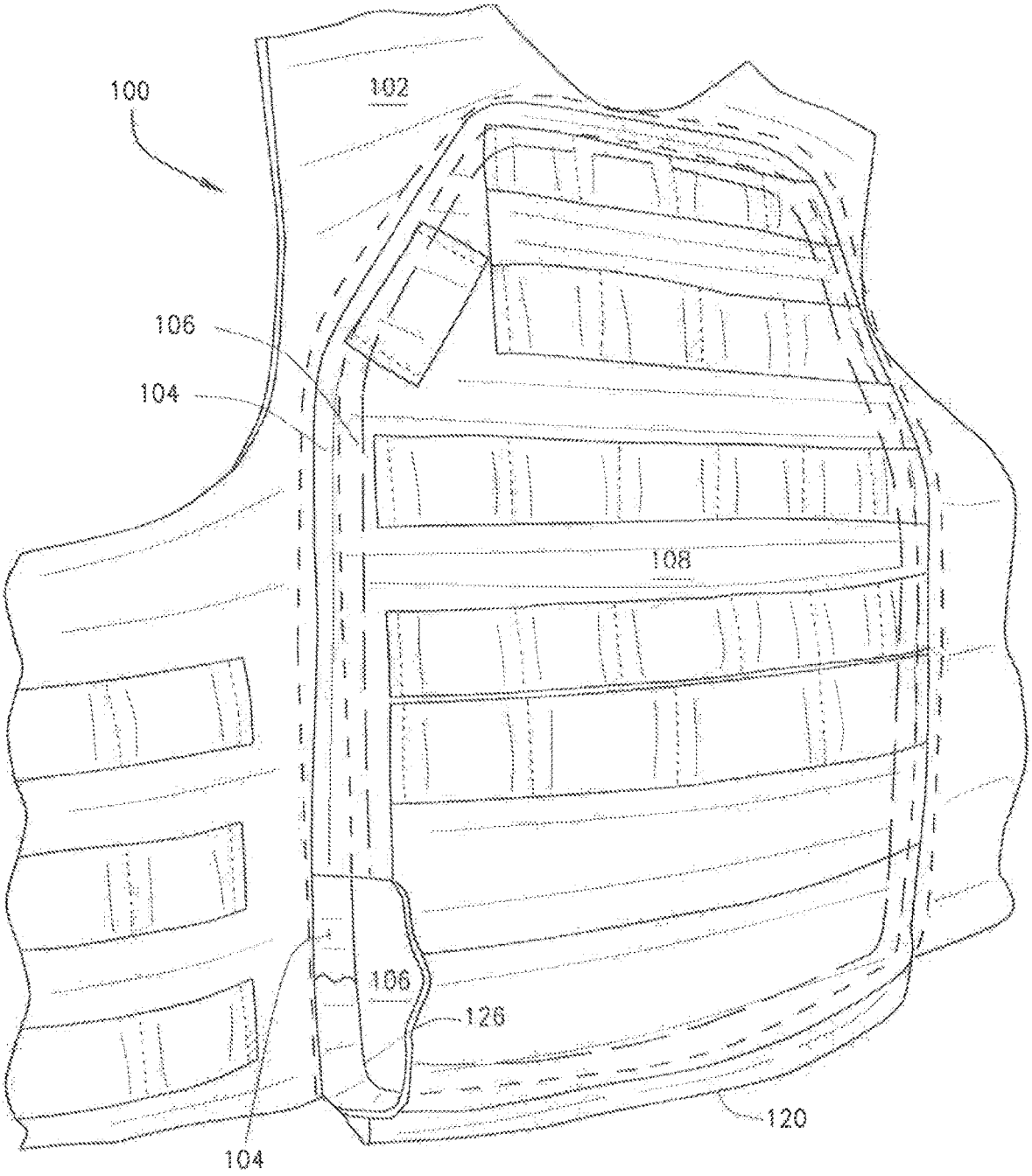
FIG. 2 is a perspective view of a first embodiment of a ballistic vest system.
Figure 3:
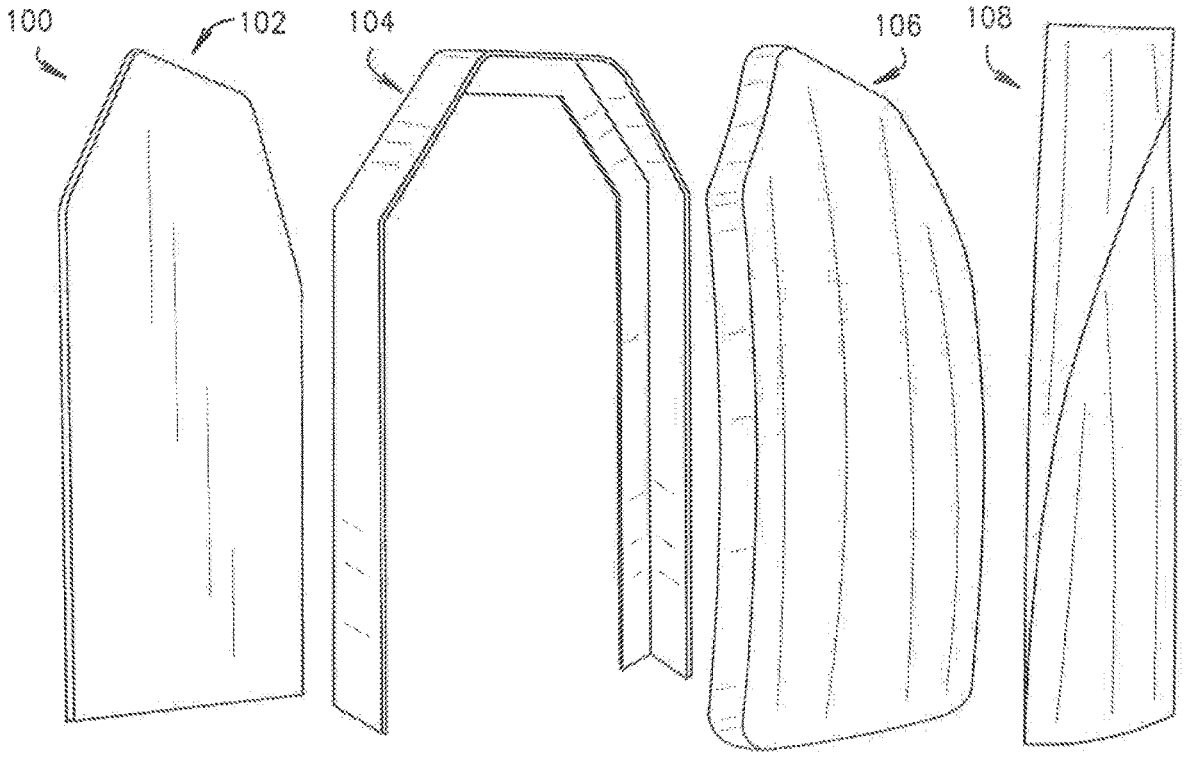
FIG. 3 is an exploded view of the ballistic vest system of FIG. 2 including a ballistic vest plate carrier, a ballistic plate, a ballistic ridge component, and ballistic soft armor.

Referring to the drawings, embodiments of a ballistic vest system are illustrated and generally indicated as 100, 200 and 300 in FIGS. 2-17. In one embodiment shown in FIGS. 2-5 and 17, the ballistic vest system 100 may include a ballistic vest plate carrier 108 made from a durable, wear resistant composite fabric material, such as a woven fabric material, a nylon material, a hook and loop material such as Kevlar®, and/or a combination thereof. For example, the composite fabric material may have a front layer made from a high performance nylon laminated with a back layer made from high tenacity polymer fibers, such as various aramid fibers and high performance polyethylene fibers and the like. As shown in FIG. 2, the ballistic vest plate carrier 108 is secured to the front portion of a ballistic soft armor component 102, which is configured to be worn around the torso and chest area of an individual. In some embodiments, the ballistic soft armor component 102 may be configured to be worn substantially or completely around the torso of the individual or in other embodiments the ballistic soft armor component 102 may have substantially the same configuration as the ballistic vest plate carrier 108 and cover substantially the chest area of an individual.

Figure 4:
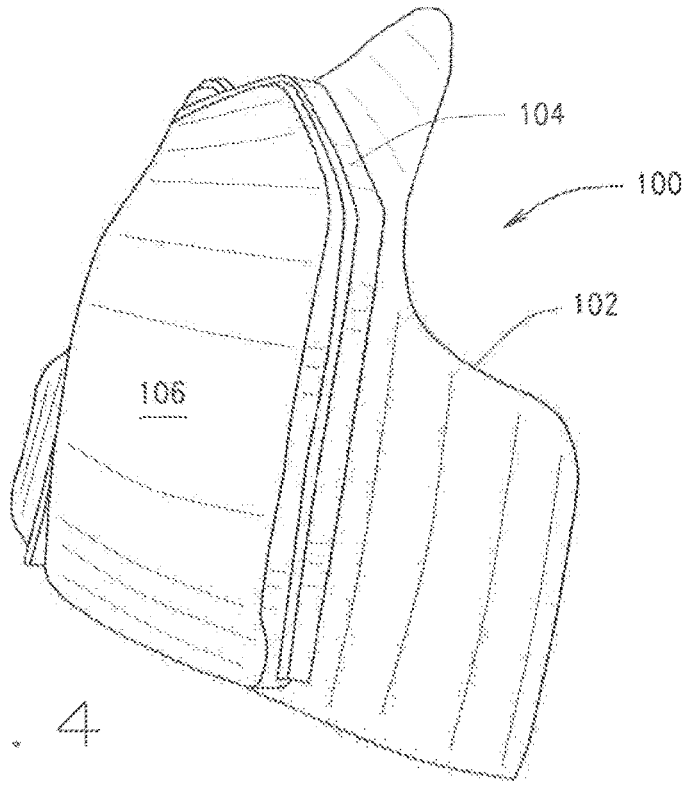
FIG. 4 is a perspective view of the ballistic plate engaged to the ballistic ridge component that rests on the ballistic soft armor.
Figure 5:
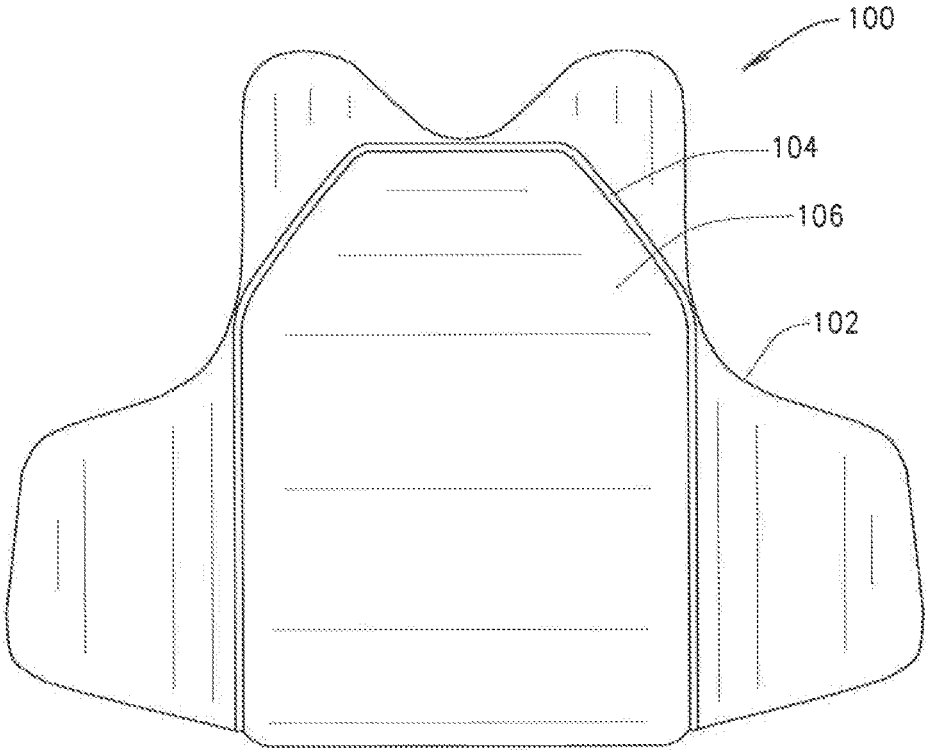
FIG. 5 is a front view of the ballistic plate engaged to the ballistic ridge component of FIG. 4.

In one embodiment the ballistic vest plate carrier 108 may define a front chest pocket 122 configured to receive a ballistic ridge component 104 engaged to a ballistic plate 106 disposed within the front chest pocket 122. As shown in FIGS. 4 and 5, the ballistic ridge component 104 is configured to engage the peripheral area 120 of the ballistic plate 106. The ballistic ridge component 104 provides protection against side spall and minimize back face deformation caused when a ballistic projectile impacts the peripheral area of the ballistic plate 106 covered by the ballistic ridge component 104. For example, the ballistic ridge component 104 is configured to cover both the peripheral edge 122 and a peripheral area 120 of the ballistic plate 106. In some embodiments, the ballistic ridge component 104 may be made from a polyethylene material; however, other types of thermoplastic materials may be used to manufacture the ballistic ridge component 104. For example, the ballistic ridge component 104 may be made from a stretchable and elastic spandex material reinforced with a unidirectional and/or aramid material.

Figure 17:
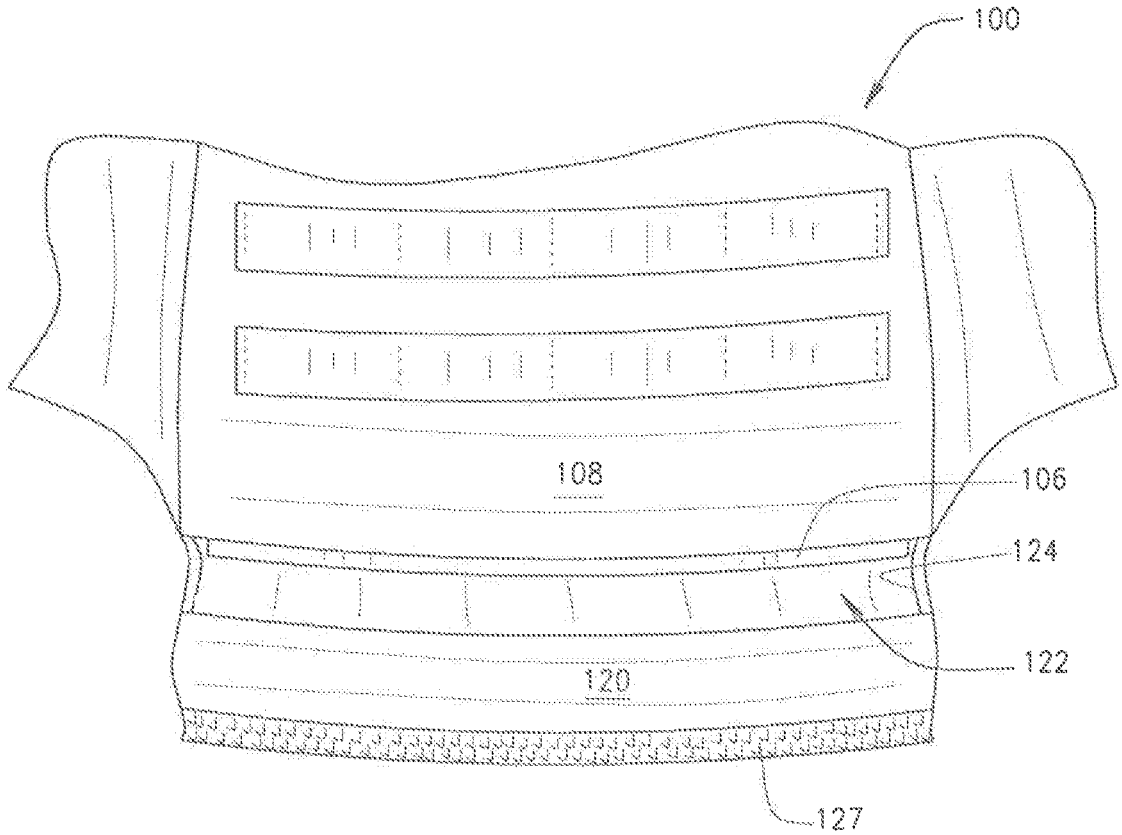
FIG. 17 is a partial elevated perspective view of the ballistic vest plate carrier of FIG. 2.

Referring to FIG. 17, as noted above the ballistic vest plate carrier 108 forms an opening 124 in communication with the front chest pocket 122 configured to receive the ballistic plate 106 therein. In addition, the ballistic vest plate carrier 108 may include a ballistic flap 120 that covers the opening 124 to the front chest pocket 122 and is configured to cover and protect the bottom portion of the ballistic plate 102 when disposed within the pocket 122. In some embodiments, the ballistic flap 120 may be made from a soft armor material that, in combination with the ballistic ridge component 104, assists in preventing side spall and backside deformation along the bottom portion of the ballistic plate 106. In some embodiments, the ballistic flap 120 may include a securing arrangement 127, such as hook and loop arrangement, for example VELCRO® or a buckle and strap arrangement (not shown) that allows the ballistic flap 120 to be attached to the bottom portion of the ballistic vest plate carrier 108 to close off the opening 124 and retain the ballistic plate 106 within the front chest pocket 122 of the ballistic vest plate carrier 108.

As further shown in FIG. 2, in some embodiments the ballistic vest plate carrier 108 may include a soft armor liner 126 that extends along the peripheral edge of the pocket 122 to provide further protection to the ballistic plate 106. In particular, the soft armor liner 126 may be sewn along the peripheral edge of the pocket 122 such that the soft armor liner 126 at least substantially covers the peripheral edge of the ballistic ridge component 104 when the ballistic plate 106 is disposed within the pocket 122. In some embodiments the soft armor liner 126 may be a strip of soft armor material, while in other embodiments the soft armor liner 126 may substantially or completely line the interior of the pocket 122. In some embodiments, the soft armor liner 126 may be made from a soft armor material, such as the soft armor material disclosed in U.S. patent application Ser. No. 13/161,322 filed on Jun. 15, 2011 entitled "High Performance Composite Material", which is herein incorporated by reference in its entirety; however, in other embodiments other types of soft armor material, such as KEVLAR®, may be used to form the soft armor liner 126.

Figure 6:
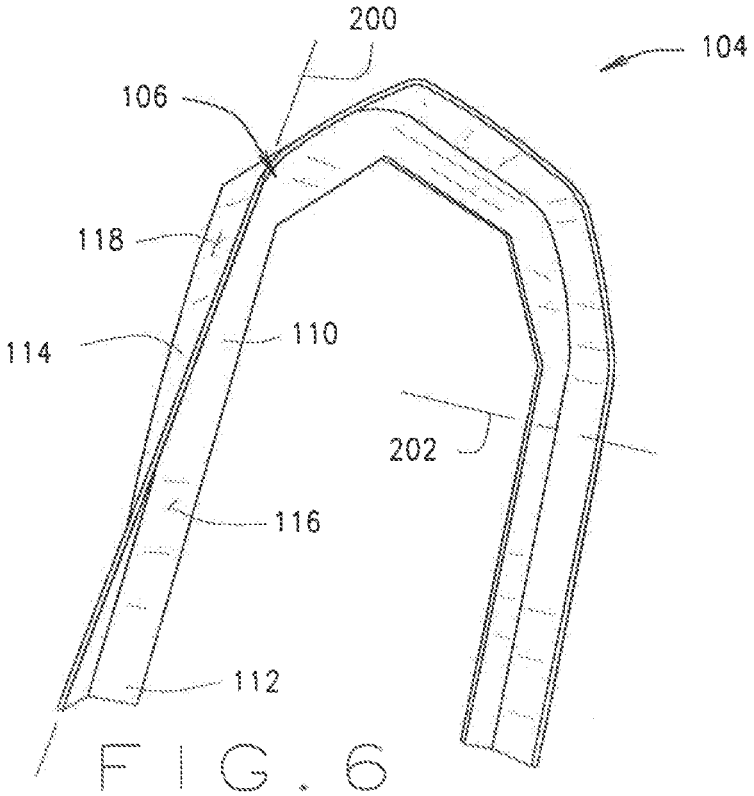
FIG. 6 is a perspective view of a first embodiment of a ballistic ridge component used with the ballistic vest system of FIG. 2.
Figure 7:
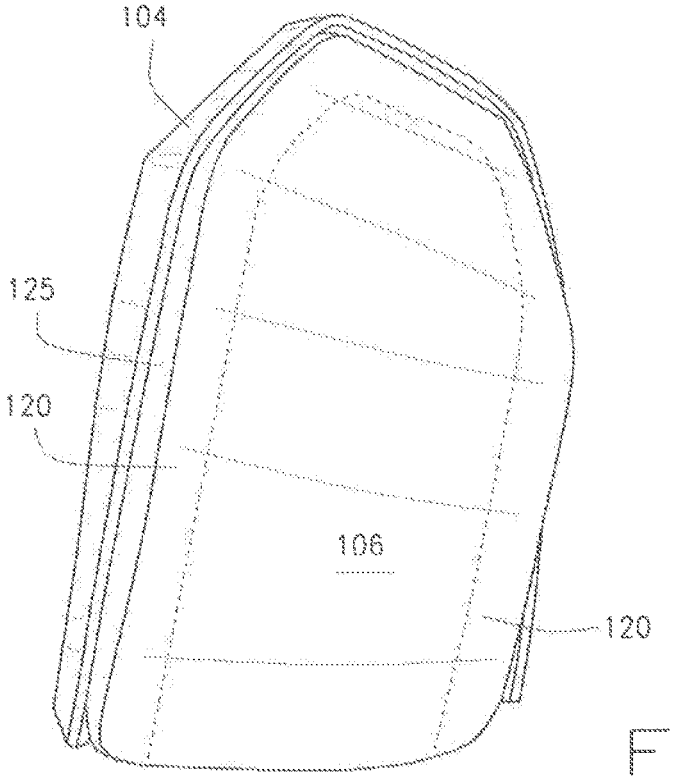
FIG. 7 is a perspective view of the ballistic vest system showing the ballistic plate engaged to the ballistic ridge component of FIG. 6.

Referring to FIG. 7, one embodiment of the ballistic ridge component 104 may have a configuration that substantially matches the peripheral edge 125 defined by the ballistic plate 102. Referring to FIG. 6, in some embodiments, the ballistic ridge component 104 defines an inner surface 110 and an outer surface 114. As further shown, the ballistic ridge component 104 may define a side portion 118 and a bottom portion 116 to form an open-ended slot 112 configured to receive the ballistic plate 106. As shown, the side portion 118 is oriented along a first axis 200, while bottom portion 116 is oriented along a second axis 202 such that the first axis 200 is in a substantially perpendicular orientation relative to the second axis 202 to form the open-ended slot 112 that extends along the periphery of the ballistic ridge component 104. By virtue of this structural arrangement, the bottom portion 116 and side portion 118 provide protection against impacts by ballistic projectiles along the front and side of the ballistic plate 106 and also prevent debris and/or shrapnel caused by side spall or head-on impacts to the ballistic plate 106 to penetrate the soft armor component 102. In some embodiments, the bottom portion 116 and side portion 118 extend along the entire periphery of the ballistic plate 106.

Figure 8:
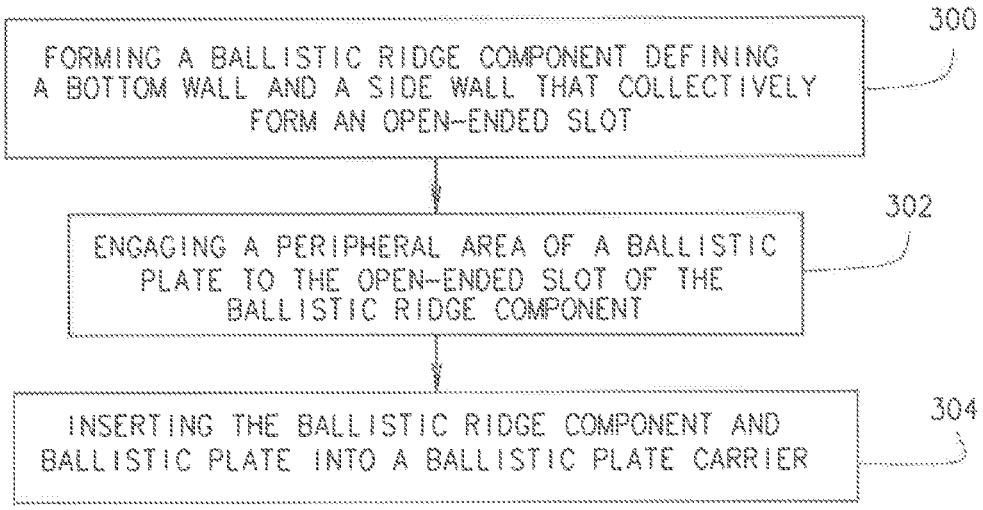
FIG. 8 is a flow chart illustrating one method for manufacturing the ballistic ridge component of FIG. 2.
Figure 10:
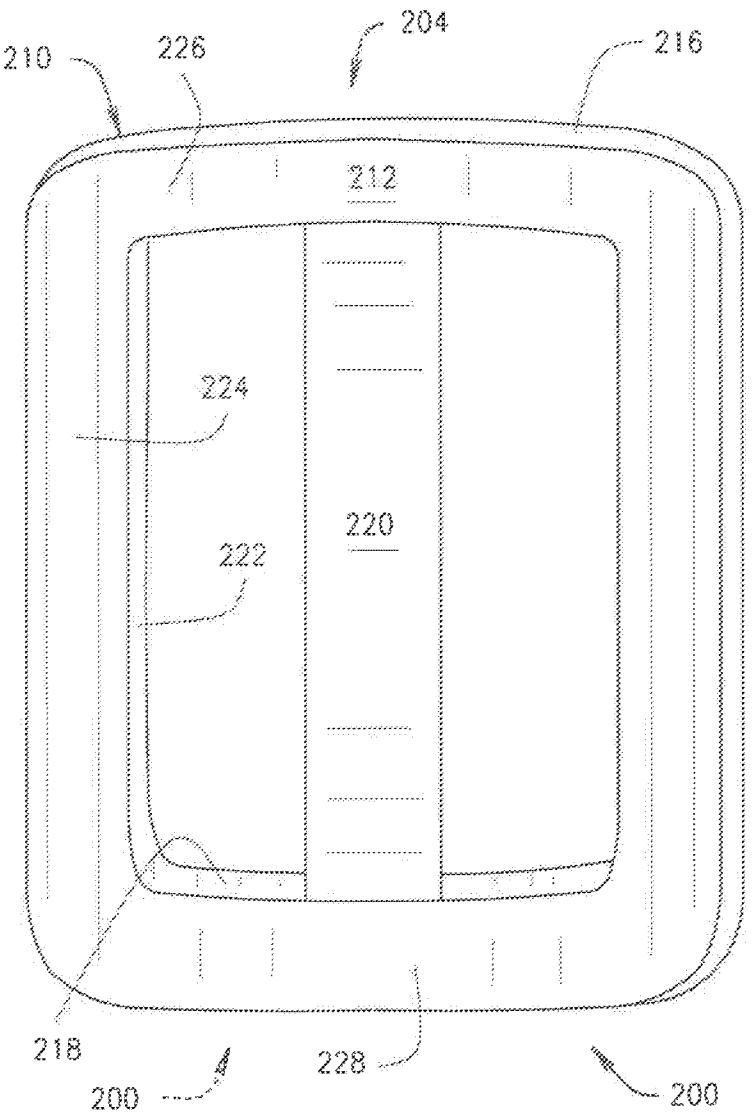
FIG. 10 is a rear view of the ballistic ridge component of FIG. 9.
Figure 9:
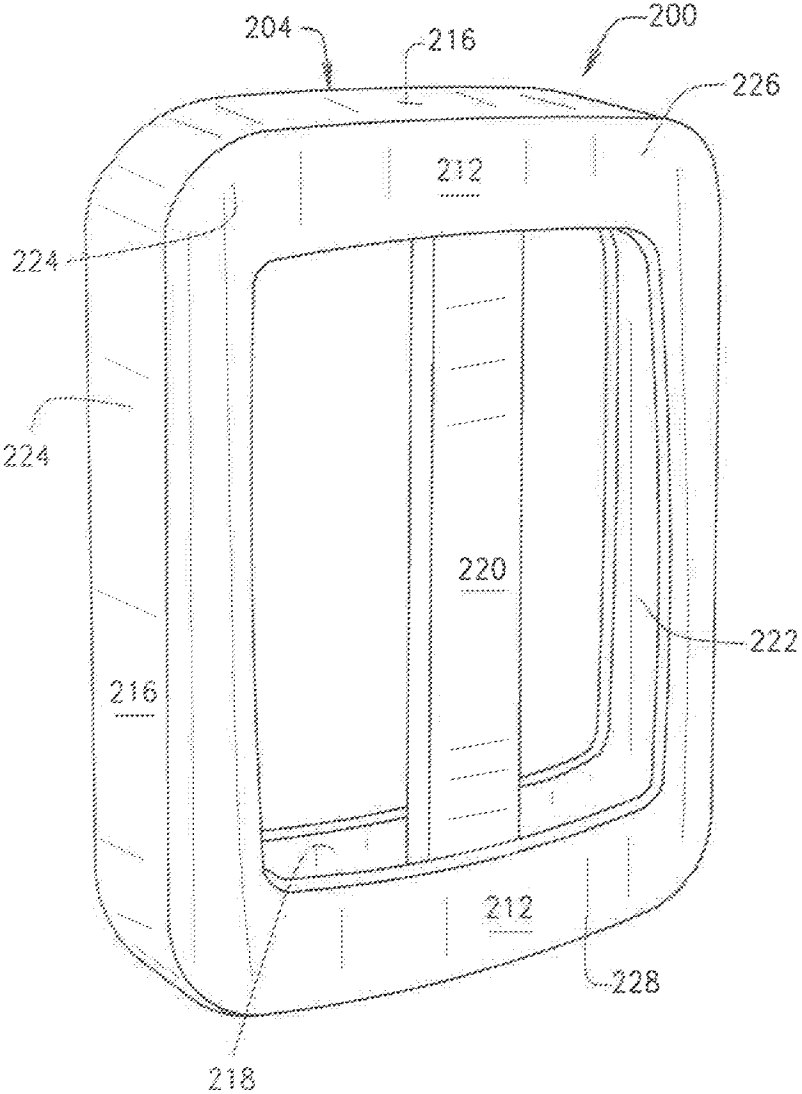
FIG. 9 is a front perspective view of a second embodiment of a ballistic ridge component.
Figure 11:
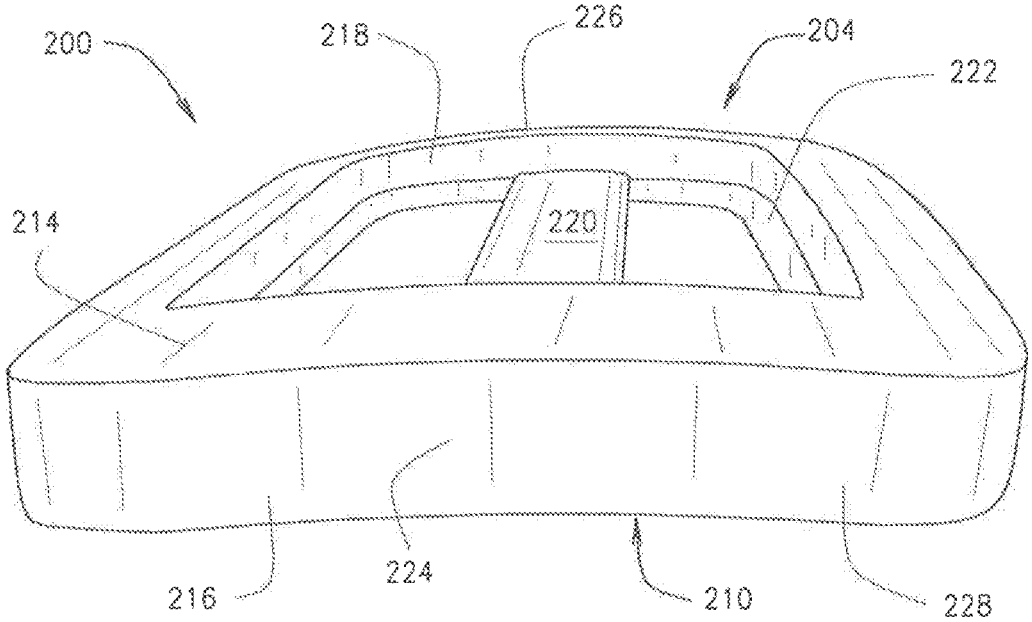
FIG. 11 is an elevated perspective view of the ballistic ridge component of FIG. 9.
Figure 12:
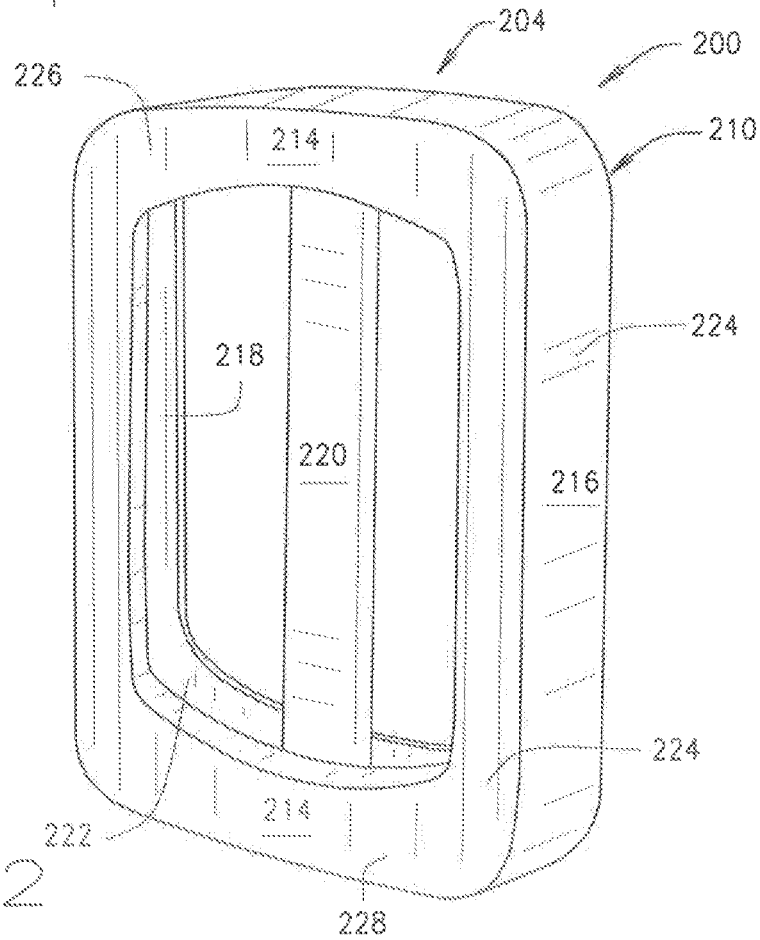
FIG. 12 is a rear perspective view of the ballistic ridge component of FIG. 9.

Referring to FIG. 8, one method for manufacturing the ballistic vest system 100 is illustrated. At block 300, forming a ballistic ridge component 104 defining a bottom wall and a side wall that collectively form an open-ended slot 112. At block 302, engaging the peripheral area of a ballistic plate 106 within the open-ended slot 112 of the ballistic ridge component 104 as illustrated in FIG. 7. In some embodiments, the ballistic plate 106 may be freely seated within the open-ended slot 112 or secured to the open-ended slot 112 by glue or other type of suitable adhesive. At block 304, inserting the ballistic ridge component 104 and the ballistic plate 106 into a ballistic vest plate carrier 108 as shown in FIG. 2. In some embodiments, the bottom portion 116 and the side portion 118 of the ballistic ridge component 104 may be integral or separate discrete pieces that are secured to one another during manufacture to form the open-ended slot 112. In other embodiments, the ballistic ridge component 104 may be configured to extend around the entire peripheral areas 125 of the ballistic plate 106.

Referring to FIGS. 9-15, another embodiment of the ballistic vest system, designated 200, may include a second embodiment of the ballistic ridge component 204. In particular, the ballistic ridge component 204 is configured to substantially encase the entire peripheral area of the ballistic plate 206 (FIGS. 15 and 16), in which both the ballistic plate 206 and the ballistic ridge component 204 are configured to be disposed within the ballistic vest plate carrier 108 (FIG. 2) and positioned in front of the soft armor component 102 (FIG. 3) when the ballistic vest system 100 is assembled.

Figure 14:
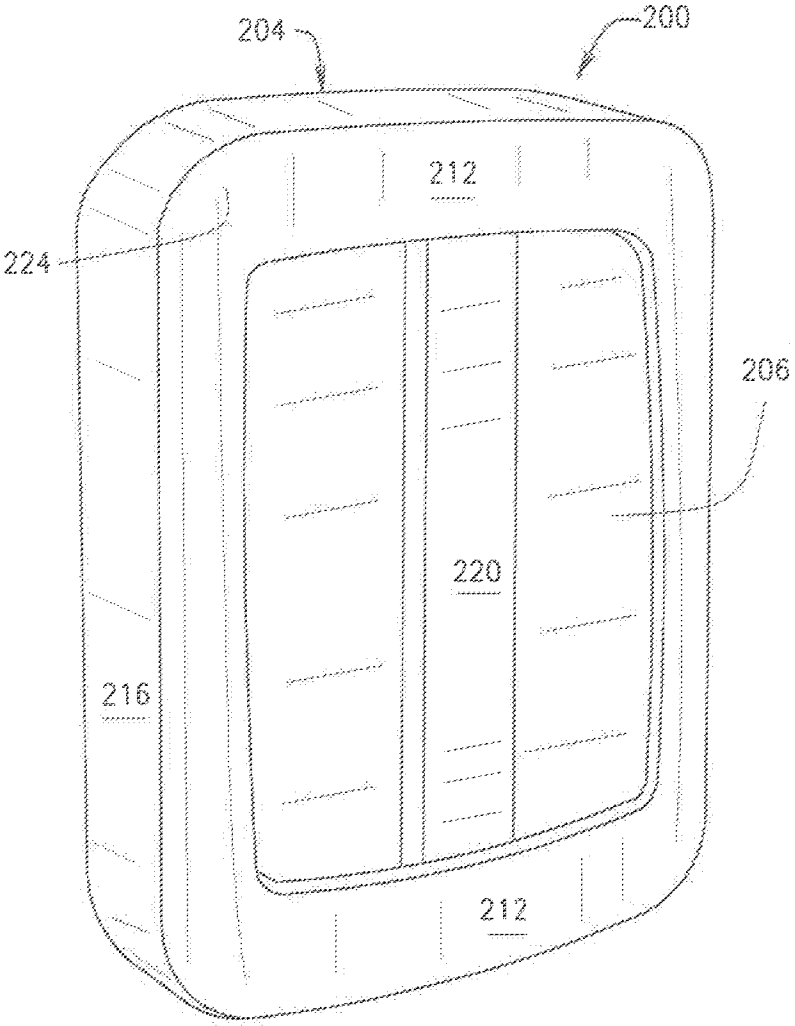
FIG. 14 is a rear perspective view of the ballistic ridge component of FIG. 9 shown engaged to the ballistic plate.
Figure 13:
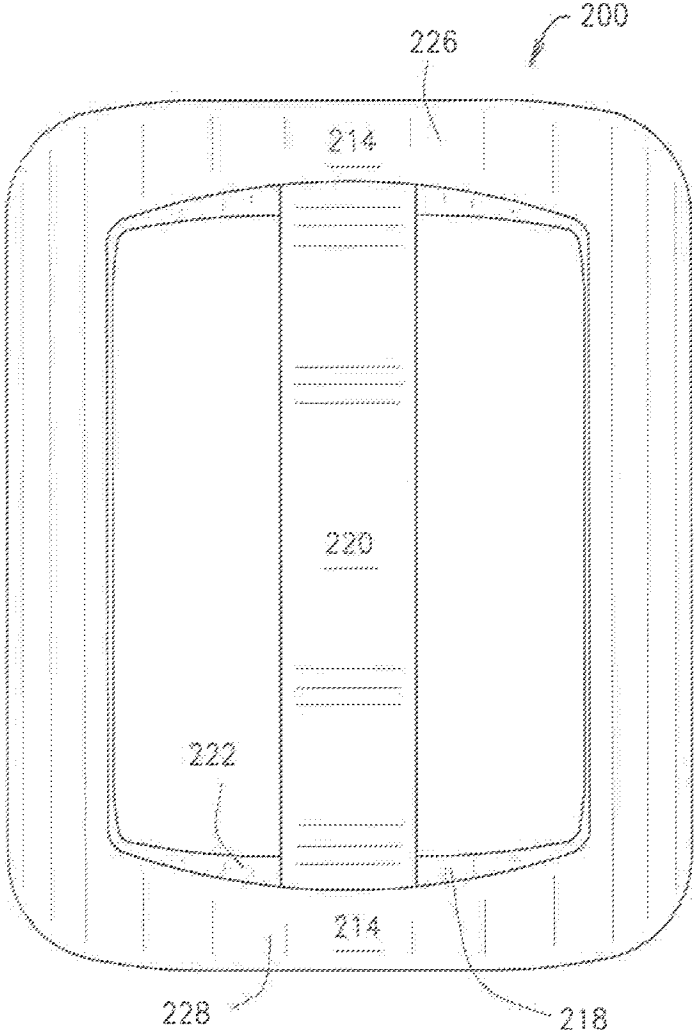
FIG. 13 is a front view of the ballistic ridge component of FIG. 9.
Figure 15:
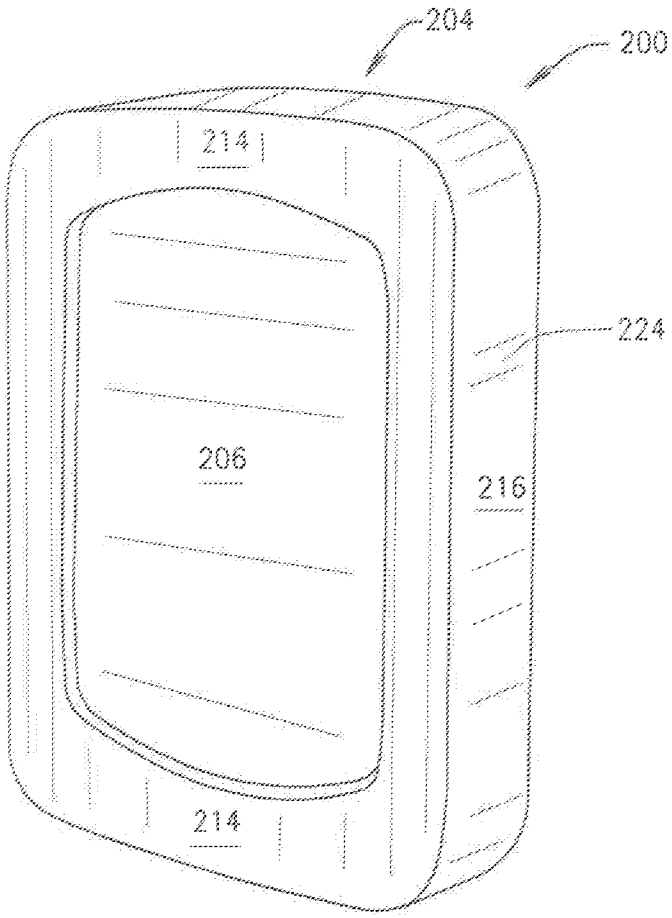
FIG. 15 is a front perspective view of the ballistic ridge component of FIG. 9 shown engaged to the ballistic plate.

In some embodiments, the ballistic ridge component 204 includes a body 210 that defines a rear surface 212, a front surface 214, a side surface 216, and an interior surface 222. The interior surface 222 formed on the opposite side of the rear surface 212, front surface 214 and side surface 216 of the ballistic ridge component 204 may collectively define a channel 218 that is configured to substantially cover the entire peripheral area for the ballistic plate 206 when the ballistic ridge component 204 is engaged to the ballistic plate 206 as shown in FIGS. 14 and 15.

Referring back to FIGS. 9-13, in some embodiments the body 210 of the ballistic ridge component 204 may further include a middle portion 220 that is secured to the interior surface 222 of the body 210 and extends from an upper portion 226 of the body 210 to the lower portion 228 of the body 210. The middle portion 220 provides further structural support to maintain the ballistic plate 206 within the confines of the ballistic ridge component 204. In some embodiments, the middle portion 220 may be secured to the interior surface 222 proximate the rear surface 212 of the ballistic ridge component 204. In other embodiments, the middle portion 220 may be secured to the interior surface 222 proximate the front surface of the ballistic ridge component 204. In yet other embodiments, the middle portion 220 may extend in perpendicular fashion relative the upper portion 226 and the lower portion 228 as shown in FIGS. 9-13, although in other embodiments the middle portion 220 may extend in parallel fashion relative to the upper and lower portions 226 and 228.

In some embodiments, the upper portion 226 of the ballistic ridge component 204 may be made an aramid/unidirectional material, while the lower portion 228 of the ballistic ride component 204 is made from the same aramid/unidirectional material. In some embodiments, the ballistic ridge component 204 may be made from a stretchable fabric composite material that allows the ballistic ridge component 204 to easily engage the peripheral area of the ballistic plate 206. In some embodiments, the body 210 of the ballistic ridge component 204 may have a generally rectangular-shaped body, although in other embodiments the body 210 of the ballistic ridge component 204 may be configured to substantially match the configuration of the ballistic plate 206.

In some embodiments, the body 210 of the ballistic ridge component 204 may be stitched and sewn together as indicated by the various stitching patterns 224 shown in FIGS. 9-15. In other embodiments, the ballistic ridge component 204 may have a unitary construction that does not require sewing or stitching to form the body 210.

Figure 16:
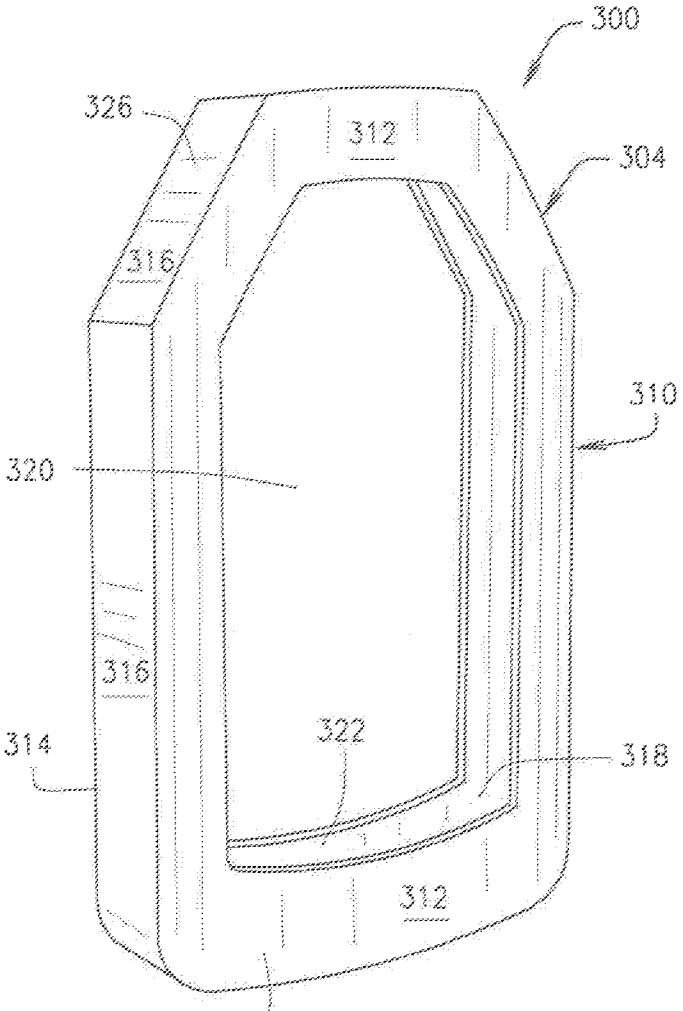
FIG. 16 is a front perspective view of a third embodiment of a ballistic ridge component.

Referring to FIGS. 16 and 17, another embodiment of the ballistic vest system, designated 300, may include a third embodiment of the ballistic ridge component 304. Similar to the other embodiments, the ballistic ridge component 304 is also configured to substantially encase the entire peripheral area of the ballistic plate 306.

Referring specifically to FIG. 16, the ballistic ridge component 304 may define a rear surface 312, a front surface 314, a side surface 316, and an interior surface 322. The interior surface 322 is formed on the opposite side of the rear surface 312, front surface 314 and side surface 316 of the ballistic ridge component 304 and collectively defines a channel 318 that is configured to substantially cover the entire peripheral area for the ballistic plate 306 when the ballistic ridge component 304 is engaged to the ballistic plate 306 as shown in FIG. 17. In addition, the rear and front surfaces 212 and 214 collectively define an opening 320 that exposes the non-peripheral area of the ballistic plate 306 when the ballistic ridge component 304 is engaged to the ballistic plate 306.

In some embodiments as shown in FIG. 16, the body 310 of the ballistic ridge component 304 may have an upper portion 226 that has a tapered configuration and a lower portion 228 that has a generally rectangular configuration. In other embodiments, the body 210 may be configured to substantially match the configuration of the ballistic plate 306.

It should be understood from the foregoing that, while particular embodiments have been illustrated and described, various modifications can be made thereto without departing from the spirit and scope of the invention as will be apparent to those skilled in the art. Such changes and modifications are within the scope and teachings of this invention as defined in the claims appended hereto.

What is claimed is:

1. A ballistic vest system comprising:

a ballistic vest plate carrier defining a front pocket and including a ballistic soft armor component defining a soft armor body;

a ballistic plate defining a plate body having a front and a back and forming a peripheral edge, the ballistic plate configured to be installed within the front pocket of the ballistic vest plate carrier; and a ballistic ridge component having a unitary construction and defining an inner surface and an outer surface, the inner surface configured to engage the front of the ballistic plate and the outer surface defining an opening expositing a portion of the ballistic plate, the outer surface configured to cover and provide protection against impacts along the front and side of the ballistic plate and prevent shrapnel caused by side spall or head-on impacts to the ballistic plate to penetrate the soft armor body.

2. The ballistic vest system of claim 1, wherein the ballistic vest plate carrier is made from at least one of a nylon material, a polymer fiber material, a polyethylene material, an aramid fiber material.

3. The ballistic vest system of claim 1, wherein the ballistic ridge component is made from at least one of a nylon material, a stretchable spandex material, a polyethylene material and an aramid fiber material.

4. The ballistic vest system of claim 1, wherein a soft armor liner extends along the front pocket of the ballistic vest plate carrier such that the soft armor liner is substantially aligned with the ballistic plate when the ballistic plate is disposed within the front pocket.

5. The ballistic vest system of claim 4, wherein the soft armor liner is attached to a peripheral edge of the front pocket.

6. The ballistic vest system of claim 4, wherein the soft armor liner completely lines the front pocket of the ballistic vest plate carrier.

7. The ballistic vest system of claim 1, wherein the ballistic ridge component is configured to prevent side spall and decrease back face deformation caused by a ballistic impact against the peripheral area of the ballistic plate.

8. The ballistic vest system of claim 1, wherein the front pocket of the ballistic vest plate carrier defines an opening in communication with a ballistic flap that is configured to close off communication with the front pocket when the ballistic flap is in the closed position and open communication with the front pocket when the ballistic flap in in the open position.

9. The ballistic vest system of claim 8, wherein the ballistic flap is made from a soft armor material.

10. A method for manufacturing a ballistic vest system comprising: forming a ballistic ridge component;

forming a ballistic soft armor component defining a soft armor body, forming a ballistic plate defining a front and a peripheral edge, engaging the ballistic plate to the ballistic ridge component, the ballistic ridge component having a unitary construction and defining an inner surface and an outer surface, the inner surface configured to engage the front of the ballistic plate, and the outer surface defining an opening expositing a portion of the ballistic plate, the outer surface configured to provide protection against impacts along the front and side of the ballistic plate and prevent shrapnel caused by side spall or head-on impacts to the ballistic plate to penetrate the soft armor body;

forming a ballistic vest plate carrier defining a front pocket configured to receive the ballistic ridge component and ballistic plate therein; and disposing the ballistic ridge component and ballistic plate within the front pocket of the ballistic vest plate carrier.

11. The method of claim 10, wherein the ballistic ridge component defines a side portion and a bottom portion that collectively form an open slot.

12. The method of claim 10, wherein the ballistic ridge component is made from at least one of a nylon material, a stretchable spandex material, a polyethylene material and an aramid fiber material.

13. The method of claim 10, further comprising:

attaching a soft armor liner extending along the front pocket of the ballistic vest plate carrier.

14. The method of claim 13, wherein the soft armor liner is attached along the front pocket of the ballistic vest plate carrier such that the soft armor liner substantially covers the peripheral edge of the ballistic plate.

15. The method of claim 13, wherein the soft armor liner substantially covers the pocket.

* * * * *